US006859543B2

(12) United States Patent
Fingleton

(10) Patent No.: US 6,859,543 B2
(45) Date of Patent: Feb. 22, 2005

(54) SPEAKER SYSTEM AND METHOD FOR MAKING THE SAME

(76) Inventor: Kenneth A. Fingleton, 6010 Ivanrest SW., Byron Center, MI (US) 49315

( * ) Notice: Subject to any disclaimer, the term of this patent is extended or adjusted under 35 U.S.C. 154(b) by 149 days.

(21) Appl. No.: 10/303,929

(22) Filed: Nov. 25, 2002

(65) Prior Publication Data

US 2004/0101152 A1 May 27, 2004

(51) Int. Cl.[7] ..... H04R 1/02

(52) U.S. Cl. ..... 381/338; 381/350; 381/348; 181/153; 181/199

(58) Field of Search ..... 381/160, 182, 381/338, 341, 348, 357, 352, 353, 336, 345, 386, 388; 181/145, 146, 152, 153, 154, 158, 159, 160, 155, 188, 196, 198, 199, 205

(56) References Cited

U.S. PATENT DOCUMENTS

| | | | | |
|---|---|---|---|---|
| 3,385,393 | A | 5/1968 | Gold | 181/141 |
| 3,393,766 | A | 7/1968 | Mitchell | 381/300 |
| 3,750,838 | A | 8/1973 | Pyle, Jr. | 181/31 |
| 3,945,461 | A | 3/1976 | Robinson | 181/153 |
| 3,978,941 | A | 9/1976 | Siebert | 181/151 |
| 4,164,988 | A | 8/1979 | Virva | 181/156 |
| 4,567,959 | A | 2/1986 | Prophit | 181/156 |
| 4,580,654 | A | 4/1986 | Hale | 181/146 |
| 4,756,382 | A | 7/1988 | Hudson, III | 181/156 |
| 5,097,513 | A | 3/1992 | Jordan et al. | 381/160 |
| 5,111,509 | A | 5/1992 | Takeuchi et al. | 381/154 |
| 5,187,333 | A | 2/1993 | Adair | 181/152 |
| 5,191,177 | A | 3/1993 | Chi | 181/153 |
| D360,418 | S | 7/1995 | Spynda | D14/221 |
| D367,862 | S | 3/1996 | Goldfarb | D14/213 |
| 5,734,728 | A | 3/1998 | Meissner | 381/89 |
| 5,824,969 | A | 10/1998 | Takenaka | 181/156 |
| 5,995,634 | A | 11/1999 | Zwolski | 381/160 |
| 6,078,676 | A | 6/2000 | Takenaka | 381/338 |
| 6,320,971 | B1 | 11/2001 | Tozawa | 381/386 |

FOREIGN PATENT DOCUMENTS

| | | | |
|---|---|---|---|
| FR | 2678128 A1 * | 12/1992 | H04R/1/28 |

* cited by examiner

*Primary Examiner*—Curtis Kuntz
*Assistant Examiner*—Brian Ensey
(74) *Attorney, Agent, or Firm*—Price, Heneveld, Cooper, DeWitt & Litton, LLP

(57) ABSTRACT

A speaker system and related method for making the same include a rigid, cylindrically shaped body member with opposite ends and a hollow interior which defines a sound chamber. A base is connected with one end of the body member to support the speaker system within a building room. A high-range speaker is mounted in the sound chamber, with a diaphragm portion located within a first radial opening in the body member to direct high-range sound radially toward the listener. A bass port is mounted in a second radial opening in the body member opposite the high-range speaker, and directs low-range sound in the sound chamber radially toward the listener. A head is mounted on the end of the body member opposite the base member, and includes a mid-bass speaker with a diaphragm oriented axially outwardly, so that sound emitted therefrom is directed axially onto the surfaces of the room to naturally equalize the output of the speaker system.

16 Claims, 7 Drawing Sheets

SPEAKER SYSTEM AND METHOD FOR MAKING THE SAME

BACKGROUND OF THE INVENTION

The present invention relates to speaker systems, and more particularly to a tubular speaker system and method for making the same.

Tubular speaker systems were developed, in part, to solve certain problems associated with a cabinet style speaker enclosure. For example, cabinet style speaker enclosures are costly, due to their manufacturing and material costs. These enclosures are also relatively large and therefore difficult to incorporate aesthetically into the surrounding interior design.

However, some drawbacks have been associated with prior art tubular style speakers. These include but are not limited to the difficulty in replacing speaker components, as well as the high costs of manufacturing. In addition, it is normally not possible to alter either a floor standing cabinet style speaker or a prior art tubular style speaker, to one that may be hung or mounted off of the floor. Current speaker systems are also not capable of changing their appearance in order to suit the surrounding décor.

Further, most current speaker systems are designed to be flat across the frequency spectrum and therefore suffer from an equalization problem. The natural or most pronounced frequency that the human ear distinguishes, at low volume, is generally in the mid-range of the frequency spectrum. Accordingly, at this volume the high and low-range frequencies are less pronounced to the human ear. Therefore, a typical listener will attempt to electronically equalize the mid-range with the low and high-range by decreasing the mid-range components and increasing the low and high-range components of the frequency spectrum. A speaker system that would overcome this problem by radiating the mid-range frequency towards the upper room surfaces rather than directly towards the listener, thereby allowing indirect listening, and directing the low and high-range components directly to the listener's ear to naturally equalize the speaker system output, would be clearly advantageous.

SUMMARY OF THE INVENTION

One aspect of the present invention is a speaker system including a rigid, cylindrically shaped body member having an open top, a closed bottom, and a hollow interior which defines an internal sound chamber. The body member includes a radially extending upper opening positioned a predetermined distance from the top of the body member and a radially extending lower opening positioned a predetermined distance from the bottom of the body member. A base member is connected with the bottom of the body member and to support the speaker system in a generally vertical and free standing fashion within a building room having a ceiling. A high-range speaker unit is positioned within the hollow interior of the body member, and has a sound emitting diaphragm positioned within the upper opening of the body member, and is oriented to direct the high-range sound emitted from the high-range speaker unit, generally horizontally toward a listener within the room. A bass port is also positioned within the hollow interior of body member, and has a sound transmitting portion placed within the lower opening of the body member, and is oriented to direct the low range sound generated within the sound chamber generally horizontally toward the listener. A head member is connected with the top of the body member, and includes a mid-bass speaker unit with its sound emitting diaphragm oriented vertically upwardly so that sound emitted from the mid-bass speaker is directed vertically onto the ceiling of the room to naturally equalize the speaker system output.

Another aspect of the present invention is a speaker system including a rigid, cylindrically-shaped body member having opposite first closed and second open ends and a hollow interior which defines an internal sound chamber. The body member includes a first radially extending upper opening, positioned a predetermined distance from the first end of the body member, and a second radially extending opening, positioned a predetermined distance from the second end of the body member. A first cap member is connected with the first closed end of the body member. A high-range speaker unit is positioned within the hollow interior of the body member, and has a sound emitting diaphragm positioned within the second opening of the body member, and is oriented to direct high-range sound emitted from the high-range speaker unit toward a listener within a room. A bass port is positioned within the hollow interior of the body member, and has a sound transmitting portion positioned within the first opening of the body member, and oriented to direct low-range sound which is generated within the sound chamber toward the listener. A second cap member is connected with the second end of the body member and includes a mid-bass speaker unit having a sound emitting diaphragm oriented axially and outwardly, so that sound emitted from the mid-bass speaker unit is directed onto surfaces of the room to naturally equalize the speaker system output.

In yet another aspect of the present invention, a method for making a speaker system includes selecting a rigid, cylindrically-shaped body member having an open top, a closed bottom, and a hollow interior which defines an internal sound chamber. A radially extending upper opening is formed in the body member a predetermined distance from the top of the body member, and a radially extending lower opening is formed in the body member a predetermined distance from the bottom of the body member. A base member is then connected with the bottom of the body member. This base member is configured to support the speaker system in a generally vertical and free standing fashion within a building room. A high-range speaker unit is mounted within the hollow interior of the body member, with the sound emitting diaphragm positioned within the upper opening of the body member and is oriented to direct the high-range sound emitted from the high-range speaker unit, toward a listener within the room. A bass port is mounted within the hollow interior of the body member. The bass ports sound transmitting portion is positioned within the lower opening of the body member and is oriented to direct the low range sound generated within the sound chamber, toward the listener. A head member is mounted on the top of the body member with a mid-bass speaker unit, having a sound emitting diaphragm, being oriented axially outwardly. This allows the sound emitted from the mid-bass speaker unit to be directed onto surfaces of the room to naturally equalize the output of the speaker system.

The present speaker system is constructed to naturally equalize frequency output by radiating 50% of the mid-range and bass frequencies towards the ceiling or other room surfaces, and directing the other 50% of the low-range and 50% of the high-range frequency directly toward the listener. By directing the mid-range frequencies towards the ceiling or other room surfaces, the majority of the mid-range sound volume is initially directed away from the listener's ear, like a pipe organ, such that sound fills the room space, with the precise source of the sound being not readily discernable. All around spacious sound is thereby achieved, with a very good ratio of bass, mid-range, and treble to create clear, crisp sounds. The speaker system also possesses superior aesthetics that naturally lend themselves to custom decoration. The tubular or column shape can face nearly any direction with no unattractive backside. The exterior surface of the tubular body can be painted or stained to match the surrounding décor, or covered with fabric, wall-coverings, and the like. The speaker system is quite versatile in its aesthetic appearance, eliminates the need for a graphic equalizer, is easily repaired and further, has a long operating life.

These and other aspects, objects, and features of the present invention will be further understood and appreciated by those skilled in the art upon reading the following specification, and claims together with reference to the accompanying drawings.

DETAILED DESCRIPTION OF THE PREFERRED EMBODIMENTS

Figure 1:
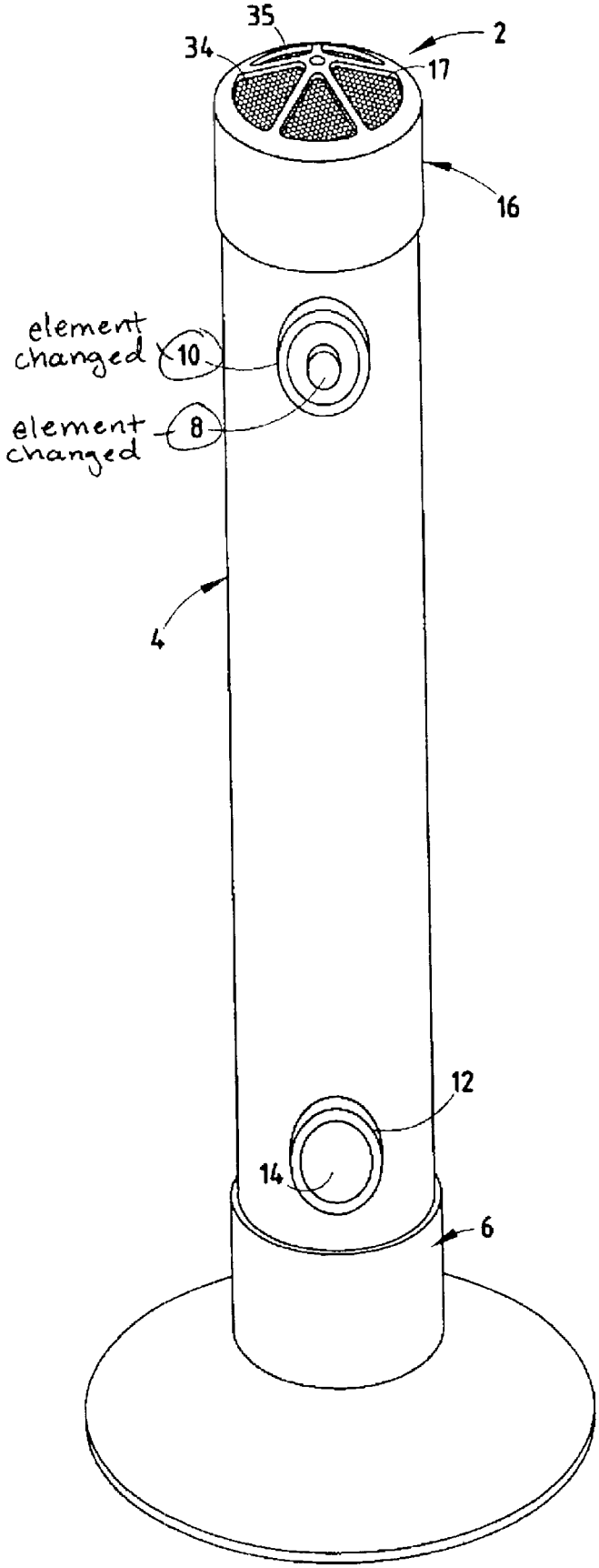
FIG. 1 is a front perspective view of a speaker system embodying the present invention.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations and step sequences, except where expressly specified to the contrary. It is also to be understood that the specific devices and processes illustrated in the attached drawings, and described in the following specification are exemplary embodiments of the inventive concepts defined in the appended claims. Hence, specific dimensions and other physical characteristics relating to the embodiments disclosed herein are not to be considered as limiting, unless the claims expressly state otherwise.

Figure 2:
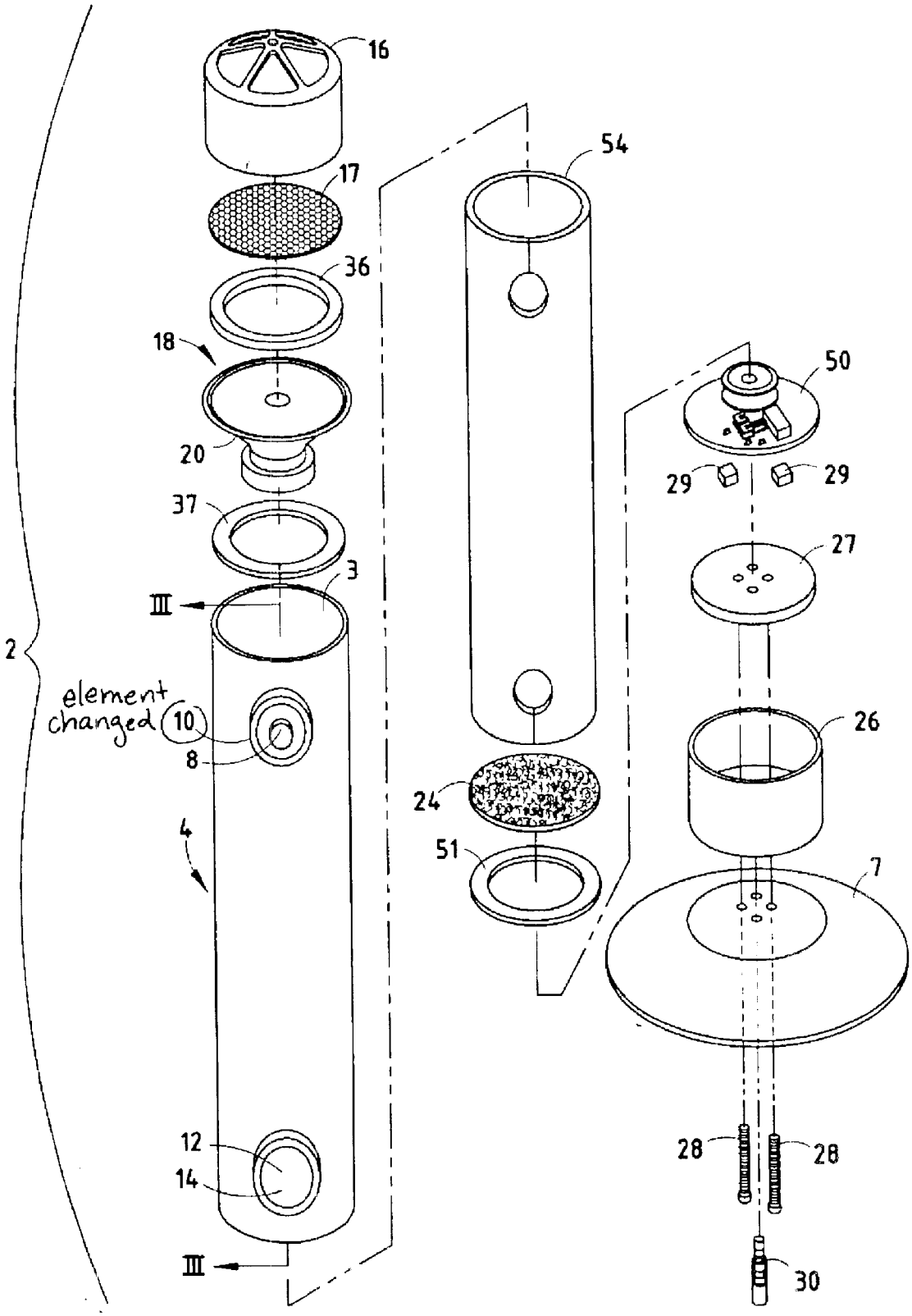
FIG. 2 is an exploded front view of the speaker system.

The reference numeral 2 (FIG. 1) generally designates a speaker system embodying the present invention, having a rigid, cylindrically-shaped body member 4 with opposite ends and a hollow interior which defines an internal sound chamber 3 (FIG. 2). A high-range speaker unit 8 is mounted within sound chamber 3 with its sound emitting diaphragm 9 located within a radially extending upper opening 10 in body member 4 to direct high-range sound radially outwardly toward the listener. A bass port 12 is mounted in a radially extending lower opening 14 in body member 4, opposite high range speaker 8, and directs low-range sound, developed within sound chamber 3, radially outwardly toward the listener. In the example shown in FIG. 1, a base member 6 is connected with one end of body member 4 to support speaker system 2 in a generally vertical orientation within a room. A head 16 is mounted on the upper end of body member 4 opposite base member 6, and includes a mid-bass speaker 18 with a sound emitting diaphragm 20 oriented directly upwardly. The mid and low-range sound emitted from the upper portion of mid-bass speaker 18 is directed axially upwardly onto the ceiling of the room to naturally equalize the output of speaker system 2. The mid-range sound, emitted from the lower portion of speaker 18, is removed by an acoustic dampener 54, while the low-range sound emitted from the lower portion is transmitted through bass port 12.

Figure 3:
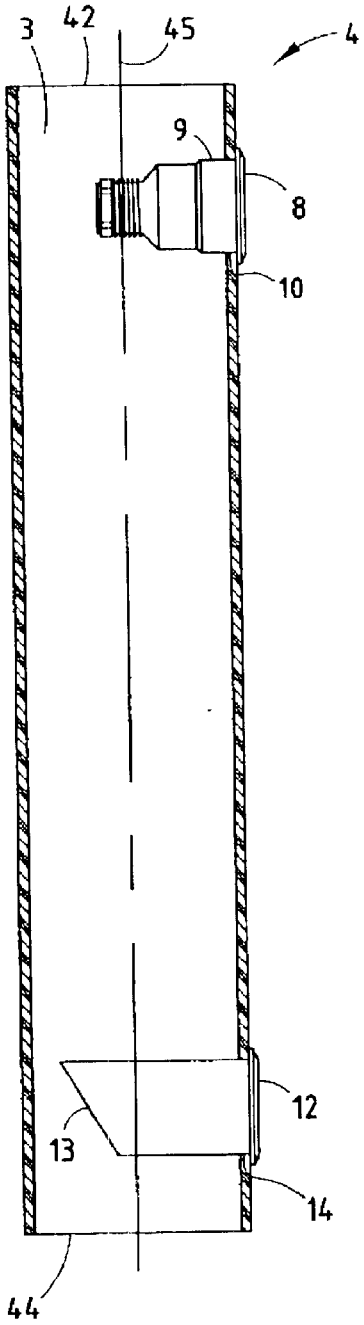
FIG. 3 is a sectional side view of a body member portion of the speaker system, taken along the line III—III, FIG. 2.

Body member 4 illustrated in FIG. 3, further includes an open top 42 and an open bottom 44 disposed on opposite ends of body member 4 in a generally perpendicular orientation with respect to a longitudinal central axis 45. Both the open top and open bottom ends 42, and 44, are positioned in a mutually parallel relationship, and are also generally vertically aligned. Open bottom 44 is closed off with a plug 24. Radially extending upper opening 10 is positioned a predetermined distance from open top 42, and radially extending lower opening 14 is positioned a predetermined distance from open bottom 44 of body member 4. Moreover, a rigid material is used to manufacture body member 4. This rigidity of body member 4 is to prevent any undesirable vibrations that may be produced during operation. Generally, a specific gravity that is approximately 0.45 greater than that of a wooden speaker enclosure is desired. Additionally, acoustic dampener 54, disposed within sound chamber 3, aids in the elimination of standing waves which could cancel the bass frequencies that are developed from the lower portion of mid-bass speaker 18 during operation (FIG. 2).

In one working embodiment of the present invention body member 4 is made from a length of circular polyvinyl chloride (PVC) tubing. This type of PVC tubing may be of the kind used in plumbing applications which is readily available in hardware stores. As best illustrated in FIG. 1, body member 4 may be approximately 39 inches in length, have an inside diameter of approximately 4 inches, with a radially extending upper opening 10 disposed approximately 4.5 inches below open top 42, and radially extending lower opening 14 disposed approximately 4.5 inches above open bottom 44 with both openings approximately 2⅜ inches in diameter. In this example, the internal volume of body member is approximately 7.8 liters. However, the examples given above are merely one working embodiment of the invention. Other materials, sizes, and shapes should not be considered to be limiting, unless expressly stated in the claims.

Additionally, the length of body member 4 may be increased or decreased. In turn, this increases or decreases the volume of internal sound chamber 3, which results in an increase or decrease of low-range sound being produced within sound chamber 3. Further, the lengthening or shortening of body member 4 allows the height of the speaker system illustrated in FIG. 1 to be raised or lowered without the use of additional costly speaker stands. For example, body member 4 may be lengthened to achieve an overall length of speaker system 2 of 45 inches for a seated audience or 60 inches for a standing audience.

As best shown in FIG. 3, high-range speaker unit 8 is positioned within radially extending upper opening 10, and includes a sound emitting diaphragm 9. The sound emitting diaphragm 9 is positioned within sound chamber 3 and is oriented to direct the high-range sound emitted, generally horizontally toward a listener within the room. In one working embodiment of the present invention, the high-range speaker is a Neodym aluminum dome tweeter having an outside diameter of 1.77 inches.

Also shown in FIG. 3 is bass port 12 positioned in radially extending lower opening 14 which is vertically aligned and parallel with high-range speaker unit 8. However, it is also possible to position bass port 12 in an orientation that is vertically aligned but on the opposite side of body member 4, respective to radially extending upper opening 10, and it is further possible to utilize both front and rear bass ports simultaneously. Bass port 12 includes a horizontally oriented tube which extends radially into sound chamber 3 and is oriented to direct the 50% of low-range sound which is generated from the lower portion of mid-bass speaker 18, generally horizontally toward the listener. Further, a base port grill 13 is disposed across on a portion of bass port 12 to protect body member 4 from the unwanted introduction of foreign materials. Bass port grill 13 may be fabricated from any perforated material. For example, in one embodiment of the present invention, grill 13 is made from a perforated fabric screen and is disposed on a 30 degree angled end of base port 12. Additionally, in this embodiment bass port 12 is made from a molded piece of rigid plastic approximately 2.40 inches in diameter and extends into sound chamber 3 approximately 3.5 inches.

Figure 4:
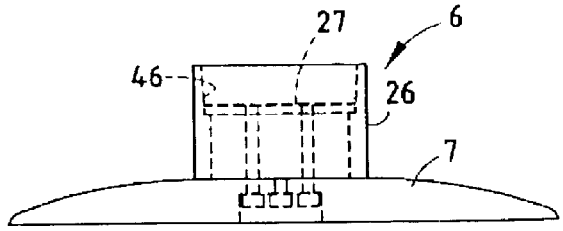
FIG. 4 is a front view of a base portion of the speaker system.
Figure 5:
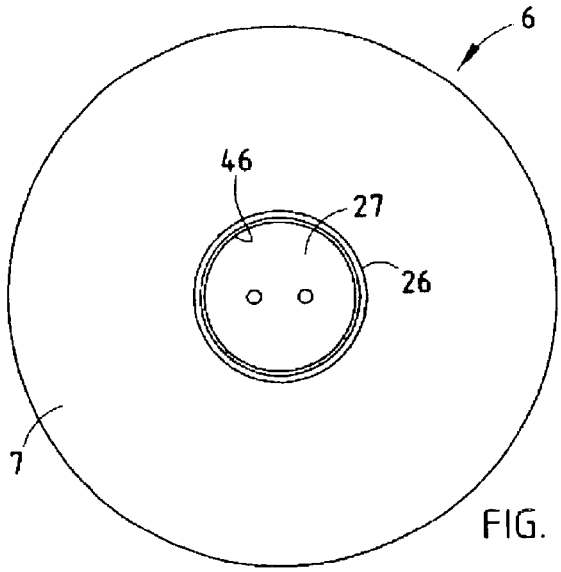
FIG. 5 is a top plan view of the base.

In the speaker system shown in FIG. 1, base member 6 is connected to the bottom of body member 4. As shown more particularly in FIGS. 4 and 5, base 6 is configured with a widened lower portion 7, a cylindrical portion 26 and a retainer 27 which fastens cylindrical portion 26 to lower portion 7 with screws 28 and bolts 29 to support speaker system 2 in a generally free standing vertical orientation. Terminals 30 are also positioned within, and extend through, lower portion 7 in order to facilitate electrical connection with a crossover 50. Also illustrated is the interior of base member 6 which includes an inclined interior surface 46. During installation of base member 6, the exterior surface of body member 4 enters inclined surface 46 and frictionally engages inclined surface 46. This frictional taper fit allows base member 6 to be securely, yet detachably connected to body member 4 without the use of a separate fastening system. This method of attachment facilitates the repair and replacement of base 6, as well as a crossover circuit 50, and if used, a multiple of switches 52 located on base 6 (discussed below).

Figure 6:
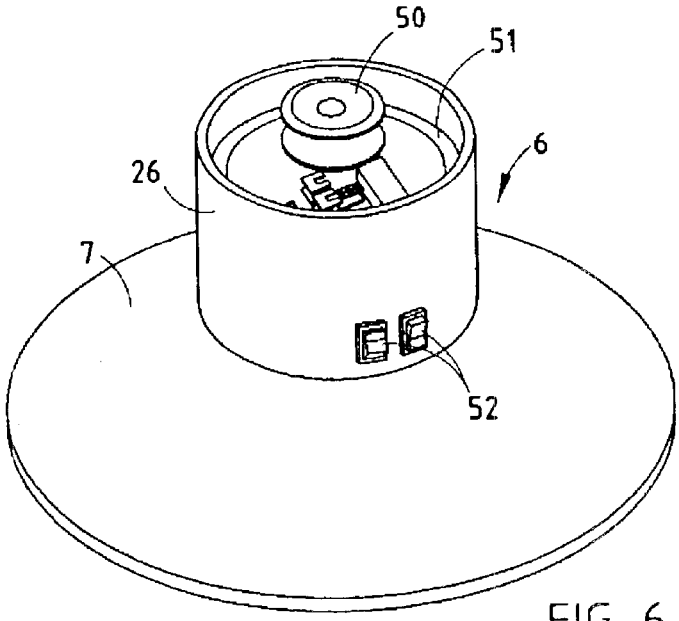
FIG. 6 is a rear perspective view of the base, shown with a cross-over circuit mounted therein.
Figure 7:
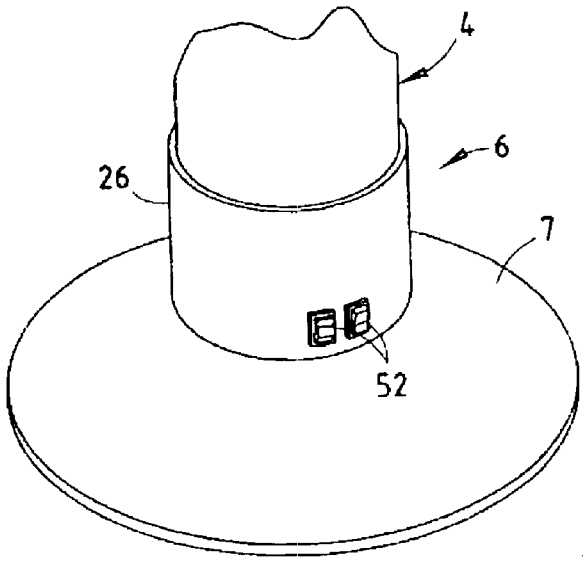
FIG. 7 is a fragmentary rear perspective view of the speaker system.

In one working embodiment of the present invention, base member 6 is made from a molded piece of rigid plastic, for example PVC, with an inverted parabolic lower portion and a cylindrical upper portion with a wall thickness of approximately one-quarter inch. The cylindrical upper portion has an inside diameter slightly larger than the outside diameter of body member 4, and tapers in size to a diameter slightly smaller than the outside diameter of body member 4. Base member 6 also includes cross-over circuit 50 disposed within cylindrical portion 26, fastened with circular ring 51, and is adapted to regulate the frequency output to each speaker of speaker system 2 (FIGS. 2 and 6). Additionally, two on-off style switches 52 are operatively connected to cross-over circuit 50. One switch is used to increase the high-range sound emitted, and one switch is to increase the mid-range sound emitted. Both switches are disposed on the rear side of base member 6 (FIG. 7).

Figure 8:
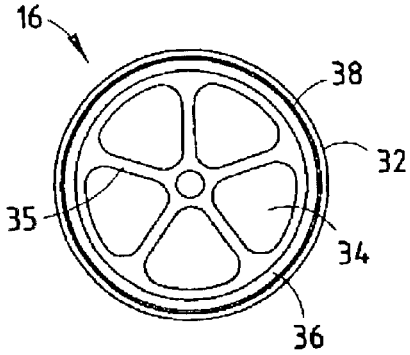
FIG. 8 is a bottom view of a head portion of the speaker system.

The illustrated speaker system includes a cap-shaped head member 16, positioned on the upper end of body member 4 opposite base member 6 (FIGS. 2 and 8). Head 16 further includes an inclined interior surface 38 in a cylindrical side wall 32 for engaging the exterior surface of body member 4, thereby securely fastening head member 16 to the top of body member 4 without the use of a separate fastening system. This tapered fit allows head 16 to be assembled to, or removed from, body member 4 and facilitates the repair and replacement of head 16 or mid-bass speaker 18.

Figure 9:
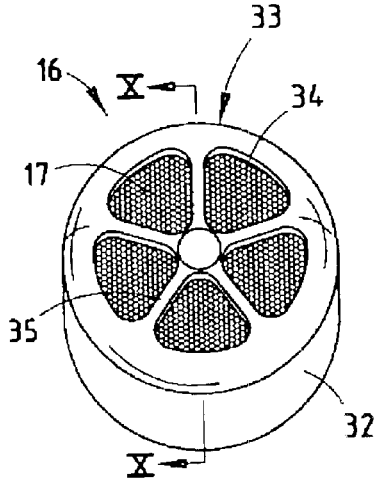
FIG. 9 is a top perspective view of the head.
Figure 10:
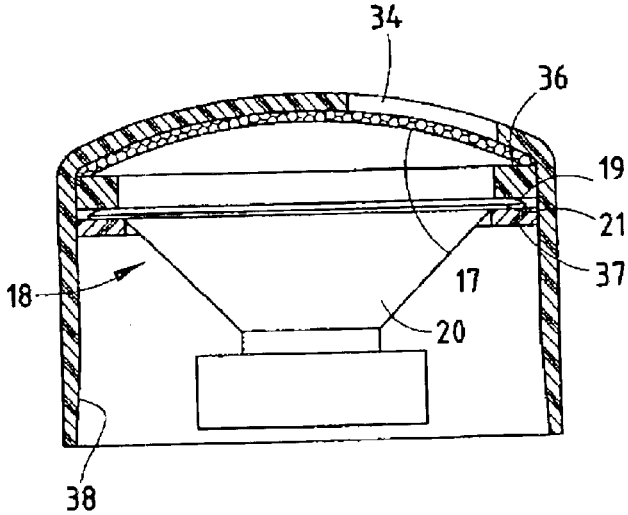
FIG. 10 is a sectional side view of the head, taken along line X—X, FIG. 9.

As shown in FIG. 9, head 16 includes a speaker grill 33 defined by a plurality of triangular shaped sound openings 34 arranged in a circular pattern and including a plurality of ribs 35 disposed between sound opening 34. A perforate top 17 is disposed below grill 33 to conceal and protect mid-bass speaker 18 (discussed below), while simultaneously preventing retardation of the sound being emitted through the speaker grill. As shown in FIG. 10, head 16 further includes circular ring 36 and 37. As discussed below, circular ring 36 can be used alone or in conjunction with circular ring 37 to affix mid-bass speaker 18 to head 16. In the illustrated speaker system, head member 16 is used in conjunction with plug 24 to enclose body member 4 and thereby create sound chamber 3.

Mid-bass speaker 18 is generally circular in shape with diaphragm 20 oriented vertically upwardly, and is closely received in head member 16 against circular ring 36. Mid-bass speaker 18 may be supported in speaker system 2 by sandwiching speaker 18 between the top of body member 4, with its associated smaller inside diameter, and circular ring 36 with its associated larger inside diameter, thereby effectively capturing mid-bass speaker 18 between circular ring 36 and body member 4. Alternatively, speaker 18 may be affixed to head 16 utilizing circular rings 36 and 37 disposed within head 16. In this configuration, outer rim 19 of mid-bass speaker 18 is captured between circular rings 36 and 37. However, mid-bass speaker 18 may also be affixed to head 16 through various other methods including, but not limited to, adhesive retention. This concept of mounting mid-bass speaker 18 between circular rings 36 and 37 or body member 4 allows mid-bass speaker 18 to be mounted without the use of an intermediate baffle. In one working embodiment of the present invention, mid-bass speaker 18 is a shielded 4" speaker with a polypropylene diaphragm 20 and rubber surround 21.

Characteristically, mid-bass speaker 18 is permanently mounted in head 16 with diaphragm 20 oriented vertically upwardly relative to body member 4. Replacement of mid-bass speaker 18 is accomplished through the removal and replacement of the entire head-speaker assembly as illustrated in FIG. 10.

A method for making speaker system 2 includes selecting a rigid, cylindrical shaped body member 4 having an open top 42, a closed bottom, and a hollow interior which defines an internal sound chamber 3. A radially extended upper opening 10 is formed in body member 4 a predetermined distance from the top of the body member, and a radially extending lower opening 14 is formed in body member 4 a predetermined distance from the bottom of the body member 4. The base member 6 is connected with the bottom of body member 4, and is configured to support speaker system 2 in a generally vertical and free standing fashion within an associated building room. A high-range speaker unit 8 is mounted within the hollow interior of body member 4 with a sound emitting diaphragm 9 disposed within upper opening 10, and oriented to direct high-range sound emitted therefrom toward a listener within the room. A bass port 12 is mounted within the hollow interior of body member 4, with a sound transmitting portion disposed within lower opening 14, and oriented to direct low-range sound generated within sound chamber 3 towards the listener. Further, a head member 16 is mounted on top of body member 4 and encloses open top 42. Mid-bass speaker 18 having a sound emitting diaphragm 20 oriented axially outwardly is mounted within head 16, whereby sound emitted from mid-bass speaker 18 is directed onto surfaces of the room to naturally equalize the output of the speaker system.

Figure 11:
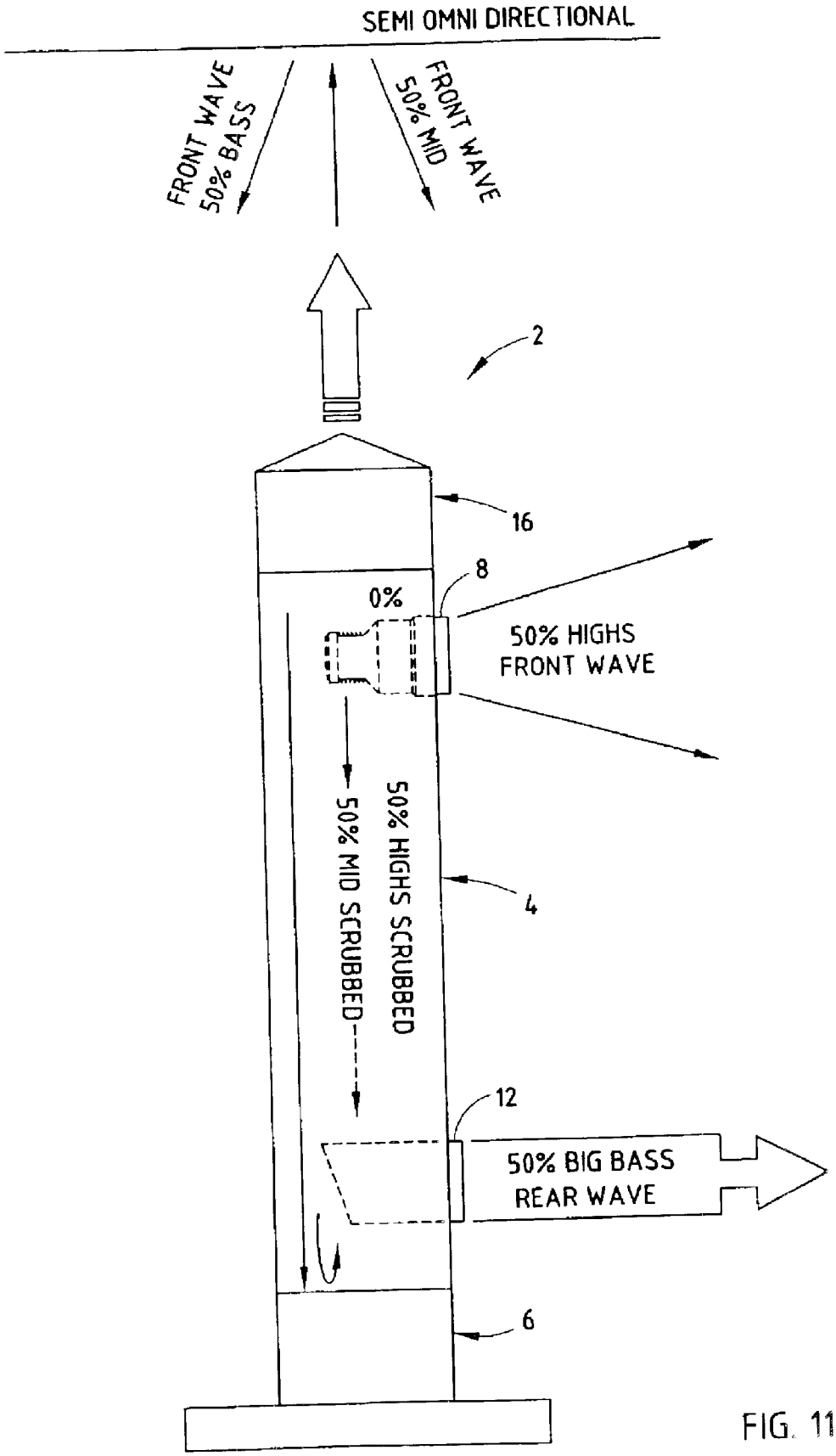
FIG. 11 is a partially schematic side view of the speaker system, shown positioned within a room.

As shown in FIG. 11, speaker system 2 operates by directing approximately 50% of the mid and bass frequencies, produced by the upper portion of upward facing mid-bass speaker 18, generally upward. These mid and bass frequencies must then reflect off of the ceiling and walls of the room in which the speaker is positioned in order to travel to the listener's ear. The other 50% of the mid-range frequencies produced by the lower portion of mid-bass speaker 18 is removed by dampener 54. In addition, 50% of the high-range frequencies, produced by the inner portion of high-range speaker 8 positioned on the side of the body member 4 are also removed by dampener 54 while the other 50%, produced by the outer portion of the speaker, are generally propagated directly towards the listener within the room. The 50% of the bass frequencies, produced by the lower portion of mid-bass speaker 18, are propagated down body member 4, reflect off of plug 24 and travel out bass port 12 generally in a direction directly toward the listener through. The effect of this configuration is to reduce the overall output of the mid-range frequency received by the listener, while simultaneously increasing the high and low frequencies received. This has the advantage of filling the room with sound frequencies and thereby presenting the listener with a non-localized source while simultaneously providing natural equalization of the sound frequencies. Additionally, body member 4 may be increased or decreased in length in order to tune the low-range output. This allows the speaker system to be tailored to a specific listening environment while concurrently eliminating the need for separate speaker stands. Still further, this has the advantage of changing the low-range output, again allowing the speaker system to be tailored to a specific listening environment.

The reference numeral 2*a* (FIG. 12) generally designates another embodiment of the present invention, having an end cap 6*a*, which permits speaker system 2*a* to be hung or otherwise mounted in a generally horizontal orientation. Since speaker system 2*a* is similar to speaker system 2 previously described and illustrated in FIG. 1, similar parts appearing in FIGS. 12–15 are represented by the same, corresponding reference numeral, except for the suffix "a" in the numerals of the latter.

Figure 12:
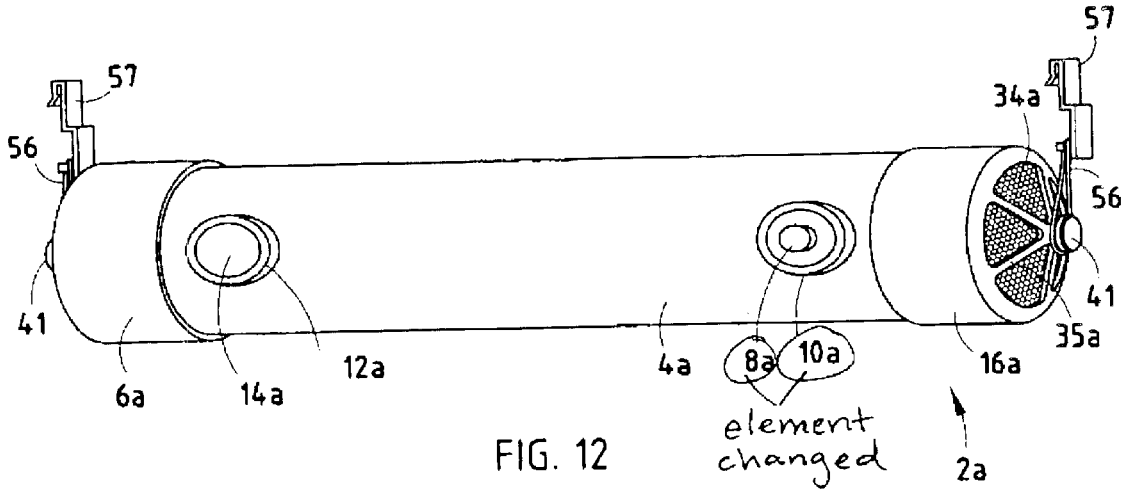
FIG. 12 is a front perspective view of a second embodiment of a speaker system embodying the present invention.
Figure 13:
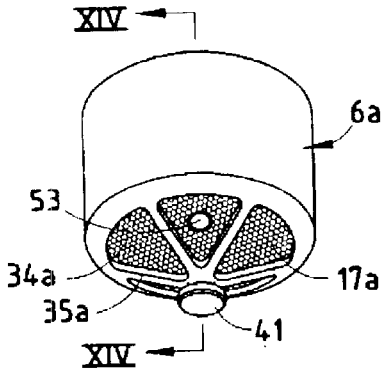
FIG. 13 is a side perspective view of the end cap portion of the speaker system shown in FIG. 12.

As illustrated in FIG. 12, speaker system 2*a* includes body member 4*a*, radially extending upper opening 10*a* with associated high-range speaker 8*a*, and radially extending lower opening 14*a* with associated bass port 12*a*. However, replacing base 6 is end cap 6*a*. End cap 6*a* also includes an inclined surface 46*a* located on the inside sidewall for removable attachment to body member 2*a*, and further includes a plurality of triangular shapes sound openings 34*a*, a plurality of ribs 35*a* and a perforate sheet 17*a*. Additionally, end cap 6*a* includes a knob 41 (FIG. 13) disposed within a fastener mechanism 40 (FIG. 14) which allows speaker system 2*a* to be suspended or fastened in an arrangement off of the floor rather than in its free standing arrangement on the floor surface. Characteristically, but not required, fastener mechanism 40 is disposed on end cap 6*a* in the center of its bottom face in an area where ribs 35*a* radially converge.

End cap 6*a* is in most respects similar to head member 16 except that instead of housing mid-bass speaker 18, a cross over circuit 50*a* is disposed within end cap 6*a* and secured by circular ring 37*a*. Further, switches 52*a* are mounted below perforated sheet 17*a* rather than on the side of the base. Switches 52*a* are then accessed through the triangular-shaped openings 34*a*. This positioning allows the end user the ability to adjust the high and low-range frequencies as described in the first embodiment, with the added advantage of having the switches concealed from view by perforated sheet 17*a* achieving a more aesthetic appearance. Additionally, a ¼ inch phone jack 53 is installed in end cap 6*a* to power speaker system 2*a*.

Figure 15:
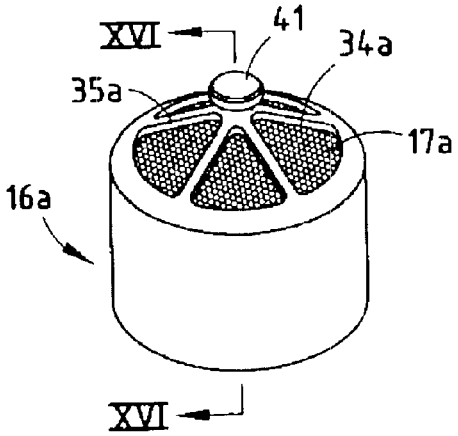
FIG. 15 is a perspective view of a modified head portion of the speaker system shown in FIGS. 12–14.

The second embodiment of the present invention also uses a slightly modified head 16*a* (FIG. 15). Modified head 16*a* houses mid-bass speaker 18*a* as described in the first embodiment. Additionally, modified head 16*a* includes a knob 41 (FIG. 15) disposed within a fastener mechanism 40 (FIG. 16) which allows speaker system 2*a* to be suspended or fastened in an arrangement off of the floor rather than in its free standing arrangement on the floor surface. Characteristically, but not required, fastener mechanism 40 is disposed on modified head 16*a* in the center of its top face in an area where ribs 35*a* radially converge.

Figure 14:
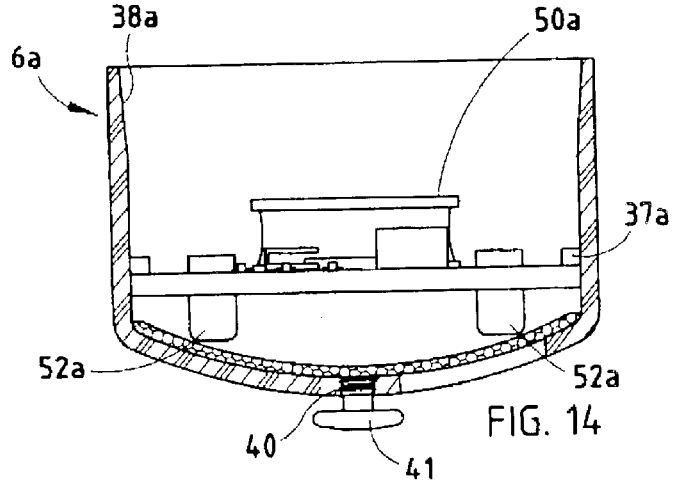
FIG. 14 is a sectional view of the end cap shown in FIGS. 12 and 13, taken along line XVI—XVI, FIG. 13.
Figure 16:
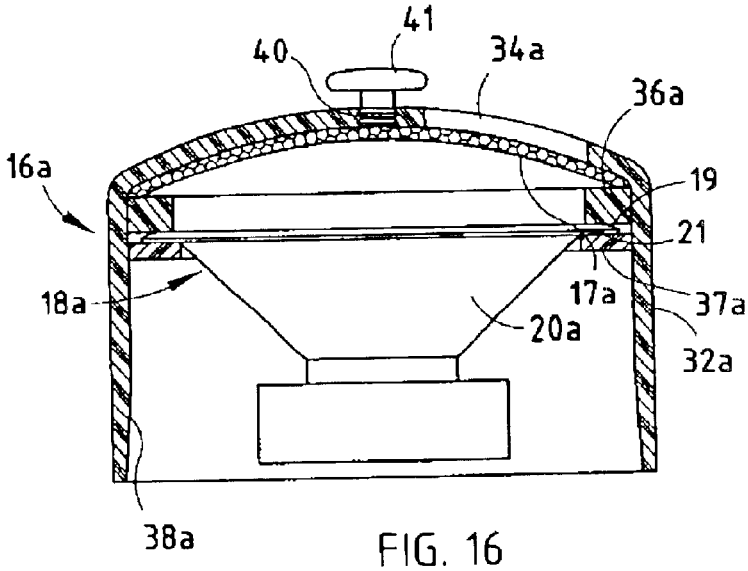
FIG. 16 is a sectional view of the modified head shown in FIGS. 12 and 15, taken along line XVI—XVI, FIG. 15.

In one working embodiment of the present invention, fastener mechanisms 40 are tapped holes which are further used to facilitate the installation of knobs 41 (FIGS. 14–16). However, any fastening mechanism could be used, as for example a protrusion, clip, hook, hole, hanger, or the like, and the examples recited are not meant to be limiting in any way unless the claims expressly state otherwise.

Figure 17:
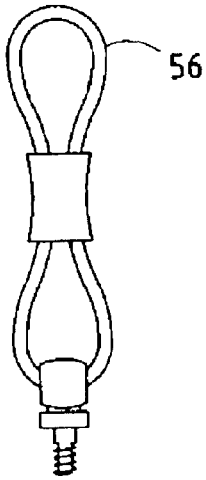
FIG. 17 is a front view of the hanger of the speaker system.
Figure 18:
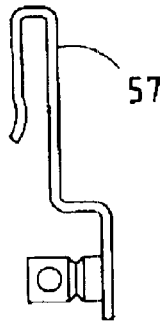
FIG. 18 is a side view of the bracket of the speaker system.

The use of modified base 6*a* and head 16*a*, both utilizing fastener mechanisms 40, allow speaker system 2*a* to be suspended off of the floor. For example as illustrated in FIG. 12, speaker system 2*a* is suspended horizontally from a typical drop-in-ceiling railing. This is accomplished through the use of a pair of hangers 56 (FIG. 17) which are attached to knobs 41. Hangers 56 are further attached to a pair of brackets 57 (FIG. 18) which are used to suspend the speaker from the railing of a drop in ceiling. However, speaker system 2*a* could be suspended or mounted to any ceiling or wall surface, and may be positioned in any orientation required by the end user.

The general aesthetic appearance of speaker system 2 or 2*a* may be changed to incorporate an unlimited number of design configurations. For example, the outer surface of speaker system 2 and 2*a* may be covered with a material such as wall-coverings, cloth, or leather. In one working embodiment of the present invention, the outer surface is covered with a wood veneer to give it the appearance of a wooden log. Unlike current speaker systems, this allows speaker system 2 and 2*a* to be incorporated into a log home while maintaining the rustic look of the home décor. The outer surface may also be painted, marbled, stained, or even etched to enhance the columnar shape, thereby allowing speaker system 2 and 2*a* to be incorporated within any surrounding décor.

It is to be understood that variations and modifications can be made on the aforementioned structure without departing from the concepts of the present invention, and further it is to be understood that such concepts are intended to be covered by the following claims unless these claim by there language expressly state otherwise.

What is claimed is:

1. A speaker system, comprising:

a rigid, cylindrically shaped body member having an open top, a closed bottom, and a hollow interior which defines an internal sound chamber; said body member including a radially extending upper opening disposed a predetermined distance from the top of said body member, and a radially extending lower opening disposed a predetermined distance from the bottom of said body member;

a base member connected with the bottom of said body member, and configured to support said speaker system in a generally vertical and freestanding fashion within an associated building room of the type having a ceiling;

a high-range speaker unit positioned within the hollow interior of said body member, and having a sound emitting diaphragm disposed within the upper opening of said body member, and oriented to direct high-range sound emitted therefrom generally horizontally toward a listener within the room;

a bass port positioned within the hollow interior of said body member, and having a sound transmitting portion disposed within the lower opening of said body member, and oriented to direct low-range sound generated within said sound chamber generally horizontally toward the listener;

a head member connected with the top of said body member, and including a mid-bass speaker unit having a sound emitting diaphragm oriented vertically upwardly, whereby sound emitted from said mid-bass speaker unit is directed generally vertically onto the ceiling of the room to naturally equalize speaker system output;

said head member is cap-shaped with a perforate top and a cylindrical sidewall depending therefrom;

said mid-bass speaker unit has a generally circular plan shape, and is closely received in said head member to support said mid-bass speaker unit directly on the open top of said body member without an intermediate baffle;

said body member includes a cylindrically shaped outer surface;

said sidewall of said head member includes an inclined interior surface which engages the exterior surface of said body member in a taper fit to securely attach said head member to the top of said body member without separate fasteners;

said head member is detachably connected with the top of said body member by a friction taper fit to facilitate repair and replacement; and said head member top includes a plurality of triangularly shaped sound openings arranged in a circular pattern with ribs disposed between said sound openings to define a speaker grill.

2. A speaker system as set forth in claim 1, wherein:

said head member includes a fastener mechanism disposed on said top to facilitate supporting said speaker system.

3. A speaker system as set forth in claim 2, wherein:

said upper opening and said lower opening in said body member are disposed in a generally parallel relationship.

4. A speaker system as set forth in claim 3, wherein:

said body member includes a longitudinally extending central axis; and said upper opening and said lower opening in said body member extend generally perpendicular to the central axis of said body member.

5. A speaker system as set forth in claim 4, wherein:

said upper opening and said lower opening in said body member are vertically aligned.

6. A speaker system as set forth in claim 5, wherein:

said bass port includes a horizontally oriented tube which extends laterally into said sound chamber.

7. A speaker system as set forth in claim 6, wherein:

said base member includes a cylindrical sidewall with an inclined interior surface which engages the exterior surface of said body member in a taper fit to securely attach said base member to the bottom of said body member without separate fasteners.

8. A speaker system as set forth in claim 7, wherein:

said base member is detachably connected with the bottom of said body member by a friction taper fit to facilitate repair and replacement.

9. A speaker system as set forth in claim 8, including:

an acoustic dampener disposed in said sound chamber.

10. A speaker system as set forth in claim 9, including:

a crossover circuit mounted in said base member, and adapted to regulate the output of said speaker system.

11. A speaker system as set forth in claim 10, including:

a perforate sheet disposed between said mid-bass speaker unit and said speaker grill to visually conceal said mid-bass speaker unit, yet avoid retarding the Sound emitted therefrom.

12. A speaker system as set forth in claim 11, including:

at least one switch operably connected with said crossover circuit and mounted below said perforate sheet.

13. A speaker system comprising:

a rigid, elongate body member having a first closed end, a second open end, and a hollow interior which defines an internal sound chamber; said body member including a first radially extending upper opening disposed a predetermined distance from the first end of said body member, and a second radially extending opening disposed a predetermined distance from the second end of said body member;

a first cap member connected with the first closed end of said body member;

a high-range speaker unit positioned within the hollow interior of said body member, and having a sound emitting diaphragm disposed within the second opening of said body member, and oriented to direct high-range sound emitted therefrom toward a listener within a room;

a bass port positioned within the hollow interior of said body member, and having a sound transmitting portion disposed within the first opening of said body member, and oriented to direct low-range sound generated within said sound chamber toward the listener;

a second cap member connected with the second end of said body member, and including a mid-bass speaker unit having a sound emitting diaphragm oriented axially outwardly, whereby sound emitted from said mid-bass speaker unit is directed onto surfaces of the room to naturally equalize speaker system output;

said second cap member includes a perforate top and a cylindrical sidewall extending therefrom;

said mid-bass speaker unit has a generally circular plan shape, and is closely received in said second cap member to support said mid-bass speaker unit directly on the open second end of said body member without an intermediate baffle;

said body member includes a cylindrically shaped outer surface;

said sidewall of said second cap member includes an inclined interior surface which engages the exterior surface of said body member in a taper fit to securely yet removably attach said head member to the top of said body member without separate fasteners; and said second cap member includes a fastener mechanism disposed on said top to facilitate supporting said speaker system from a ceiling portion of the room.

14. A speaker system as set forth in claim 13, wherein:

said body member includes a longitudinally extending central axis;

said upper opening and said lower opening is said body member extend generally perpendicular to the central axis of said body member; and said upper opening and said lower opening in said body member are vertically aligned.

15. A speaker system as set forth in claim 14, further including:

a base member including a cylindrical sidewall with an inclined interior surface which engages an exterior surface of said body member in a taper fit to securely yet removably attach said base member to the bottom of said body member without separate fasteners.

16. A speaker system, comprising:

a rigid, cylindrically shaped body member having an open top, a closed bottom, and a hollow interior which defines an internal sound chamber; said body member including a radially extending upper opening disposed a predetermined distance from the top of said body member, and a radially extending lower opening disposed a predetermined distance from the bottom of said body member;

a base member connected with the bottom of said body member, and configured to support said speaker system in a generally vertical and freestanding fashion within an associated building room of the type having a ceiling;

a high-range speaker unit positioned within the hollow interior of said body member, and having a sound emitting diaphragm disposed within the upper opening of said body member, and oriented to direct high-range sound emitted therefrom generally horizontally toward a listener within the room;

a bass port positioned within the hollow interior of said body member, and having a sound transmitting portion disposed within the lower opening of said body member, and oriented to direct low-range sound generated within said sound chamber generally horizontally toward the listener;

a head member connected with the top of said body member, and including a mid-bass speaker unit having a Sound emitting diaphragm oriented vertically upwardly, whereby sound emitted from said mid-bass speaker unit is directed generally vertically onto the ceiling of the room to naturally equalize speaker system output; and said head member includes a fastener mechanism disposed thereon to facilitate supporting said speaker system.

* * * * *

UNITED STATES PATENT AND TRADEMARK OFFICE

CERTIFICATE OF CORRECTION

PATENT NO. : 6,859,543 B2 
DATED : February 22, 2005
INVENTOR(S) : Kenneth A. Fingleton It is certified that error appears in the above-identified patent and that said Letters Patent is hereby corrected as shown below:

Drawings,
Sheet 1, Fig. 1, replace Fig. 1 with corrected Fig. 1, which deletes "element changed" both occurrences and the circles around reference numerals 10 and 8.

-- --

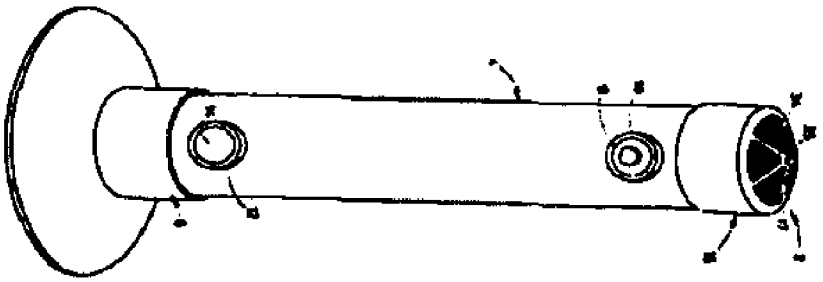

FIG 1

UNITED STATES PATENT AND TRADEMARK OFFICE

CERTIFICATE OF CORRECTION

PATENT NO. : 6,859,543 B2 
DATED : February 22, 2005
INVENTOR(S) : Kenneth A. Fingleton It is certified that error appears in the above-identified patent and that said Letters Patent is hereby corrected as shown below:

Drawings (cont'd),
Sheet 2, Fig. 2, replace Fig. 2 with corrected Fig. 2, which deletes "element changed" and the circle around reference numeral 10.

-- --

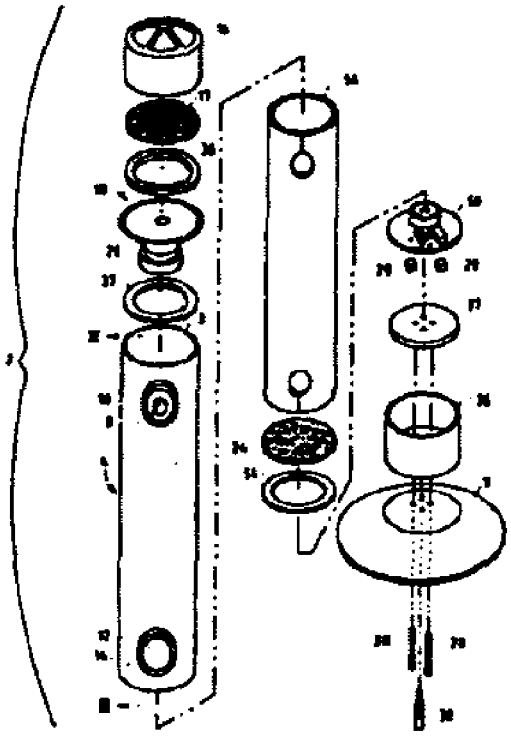

FIG. 2

UNITED STATES PATENT AND TRADEMARK OFFICE

CERTIFICATE OF CORRECTION

PATENT NO. : 6,859,543 B2 
DATED : February 22, 2005
INVENTOR(S) : Kenneth A. Fingleton It is certified that error appears in the above-identified patent and that said Letters Patent is hereby corrected as shown below:

Drawings (cont'd),
Sheet 6, Fig. 12, replace Fig. 12 with corrected Fig. 12, which deletes "element changed" and the circles around reference numerals 8a and 10a.

--

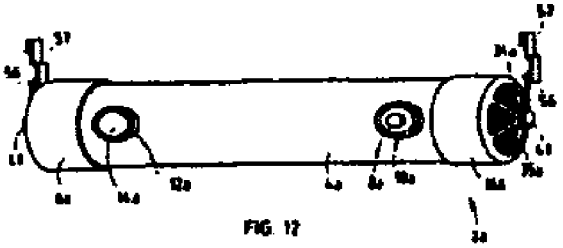

FIG. 12

--

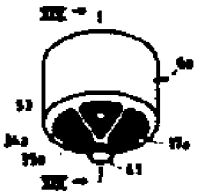

FIG. 13

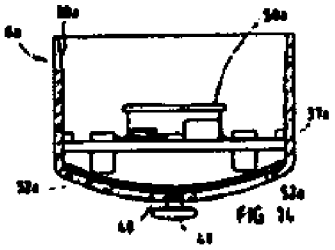

FIG. 14

UNITED STATES PATENT AND TRADEMARK OFFICE

CERTIFICATE OF CORRECTION

PATENT NO. : 6,859,543 B2
DATED : February 22, 2005
INVENTOR(S) : Kenneth A. Fingleton It is certified that error appears in the above-identified patent and that said Letters Patent is hereby corrected as shown below:

Column 3,
Line 49, "XVI-XVI" should be -- XIV-XIV --.

Column 7,
Line 43, delete "through".

Column 8,
Line 6, "shapes" should be -- shaped --.

Column 9,
Lines 1 and 5, "system 2 and 2a" should be -- systems 2 and 2a --.

Column 10,
Line 43, "Sound" should be -- sound --.

Column 11,
Line 32, "is" should be -- in --.

Column 12,
Line 32, "Sound" should be -- sound --.

Signed and Sealed this

Seventh Day of June, 2005

JON W. DUDAS
*Director of the United States Patent and Trademark Office*